US008468926B2

(12) United States Patent
Treadway et al.

(10) Patent No.: US 8,468,926 B2
(45) Date of Patent: Jun. 25, 2013

(54) BALLISTIC ARMOR SYSTEM

(75) Inventors: Sean Kevin Treadway, Mooresville, NC (US); Michael John Worsham, Mooresville, NC (US)

(73) Assignee: Corvid Technologies, Mooresville, NC (US)

( * ) Notice: Subject to any disclaimer, the term of this patent is extended or adjusted under 35 U.S.C. 154(b) by 0 days.

(21) Appl. No.: 13/224,973

(22) Filed: Sep. 2, 2011

(65) Prior Publication Data

US 2012/0090454 A1 Apr. 19, 2012

Related U.S. Application Data

(60) Provisional application No. 61/393,665, filed on Oct. 15, 2010.

(51) Int. Cl.
*F41H 5/013* (2006.01)

(52) U.S. Cl.
USPC ..... 89/36.02

(58) Field of Classification Search
USPC ..... 89/901–939, 36.01, 36.02, 36.04, 89/36.05, 36.14
See application file for complete search history.

(56) References Cited

U.S. PATENT DOCUMENTS

| | | | | |
|---|---|---|---|---|
| 848,024 | A * | 3/1907 | Gathmann | 114/10 |
| 3,730,826 | A * | 5/1973 | Matchen et al. | 428/427 |
| 4,739,690 | A | 4/1988 | Moskowitz | |
| 5,149,910 | A | 9/1992 | McKee | |
| 5,452,641 | A * | 9/1995 | Kariya | 89/36.14 |
| 5,619,821 | A * | 4/1997 | St. George et al. | 49/57 |
| 5,736,474 | A | 4/1998 | Thomas | |
| 7,163,731 | B2 * | 1/2007 | Yeshurun et al. | 428/112 |
| 2008/0236378 | A1 * | 10/2008 | Sane et al. | 89/36.02 |
| 2010/0236393 | A1 * | 9/2010 | Martin et al. | 89/36.02 |

OTHER PUBLICATIONS

Worsham, Michael J. et al., The 12th Hypervelocity Impact Symposium, "Defeat of High-Velocity Projectiles by a Novel Spaced Armor System," Procedia Engineering, 2012.

(Continued)

*Primary Examiner* — Michael Carone
*Assistant Examiner* — John D Cooper
(74) *Attorney, Agent, or Firm* — Oblon, Spivak, McClelland, Maier & Neustadt, L.L.P.

(57) ABSTRACT

An armor and a system for projectile neutralization. The armor has at least one serrated plate or louvered plate system. The serrated plate has a base, recessed lands, raised lands, and columnar projections extending from the recessed lands to the raised lands to form serrations on the serrated plate. The louvered plate system has a series of angled plates, a base, a top and a support structure connecting the louvered plates with the base and the top. The system has a serrated or louvered armor plate configured to reduce a kinetic energy of the projectile and re-orient the projectile upon rupture through the armor plate, and has a projectile-receptor configured to capture the projectile after rupture through the armor plate. Projectiles which impact on the serrated or louvered plate system have a kinetic energy thereof reduced and become re-oriented upon rupture through the serrated or louvered plate system.

19 Claims, 9 Drawing Sheets

Dual serrated plate design

OTHER PUBLICATIONS

Worsham et al., The 12th Hypervelocity Impact Symposium, "Defeat of High-Velocity Projectiles by a Novel Spaced Armor System" (Presentation), Sep. 2012, 7 pages.

Diederen, A.M. et al., "Ballistic Protection Against Armour Piercing Projectiles Using Titanium Base Armour," Proceedings of RTO AVT Specialists' Meeting on Cost Effective Application of Titanium Alloys in Military Platforms, Loen, Norway, May 2001.

Howell, R.A. et al., "Advancements in Steel for Weight Reduction of P900 Armor Plate," Proceedings of the Army Science Converence (26th), Orlando Florida, Dec. 2008, 8 pgs.

Craig, B. et al., The Department of Defense—The Amptiac Quarterly, High Performance Fibers for Lightweight Armor, vol. 9, No. 2, 2005.

Johnson, G.R. et al., "A Constitutive Model and Data for Metals Subjected to Large Strains, High Strain Rates and High Temperatures," Proceedings of Seventh International Symposium on Ballistics, The Hague, The Netherlands, pp. 541-548 (Apr. 1983).

Whipple, Fred L., "Meteorites and Space Travel," The Astronomical Journal 52, No. 1161, p. 131.

* cited by examiner

Figure 1A 0.50 caliber AP M2 bullet
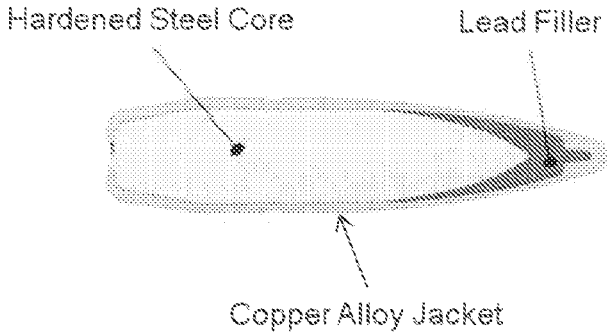
Figure 1B Projectile Impact Orientation
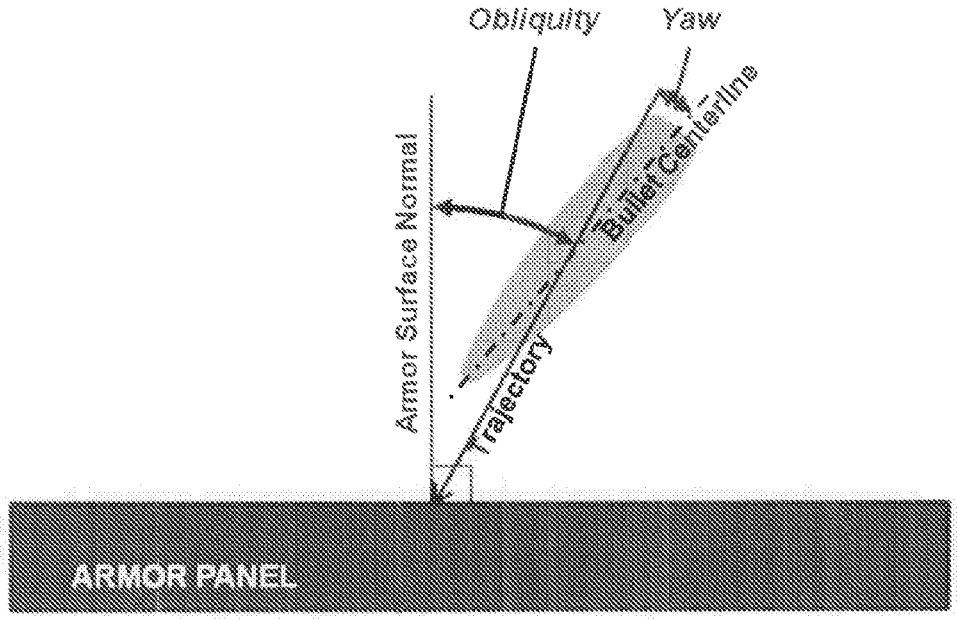

Figure 2 Sample Threat Projectiles
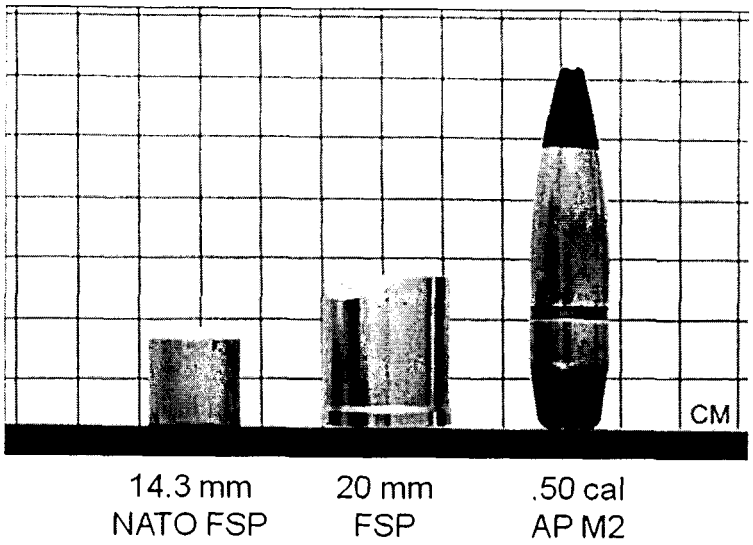
Figure 3 Serrated Plate
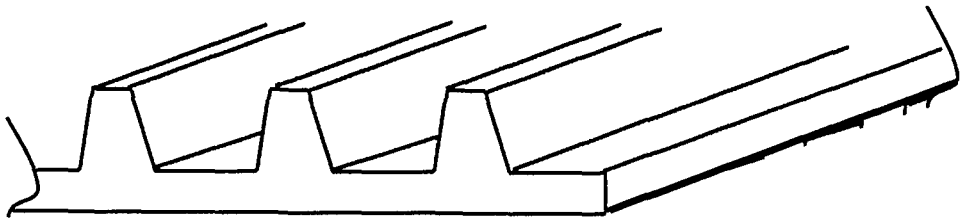

Figure 4 Cross-section of serrated plate
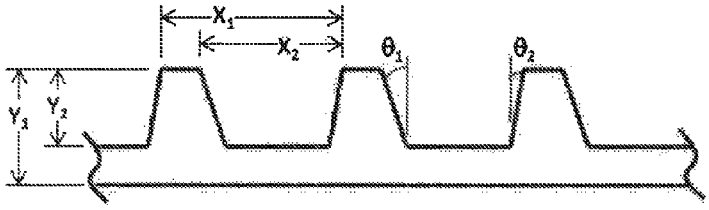
Figure 5 Dual serrated plate design
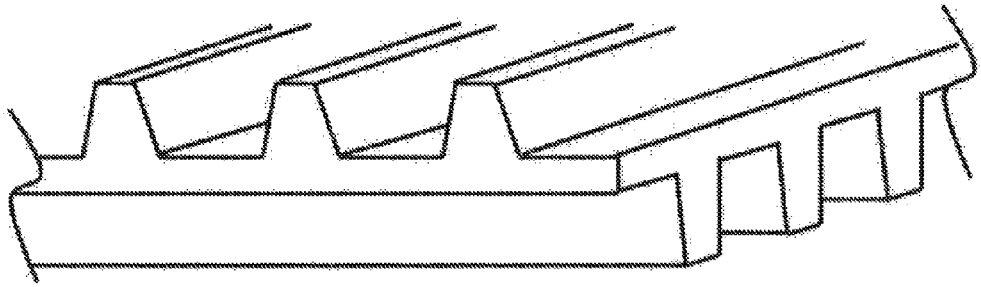
Figure 6 Example of single serrated detailed design
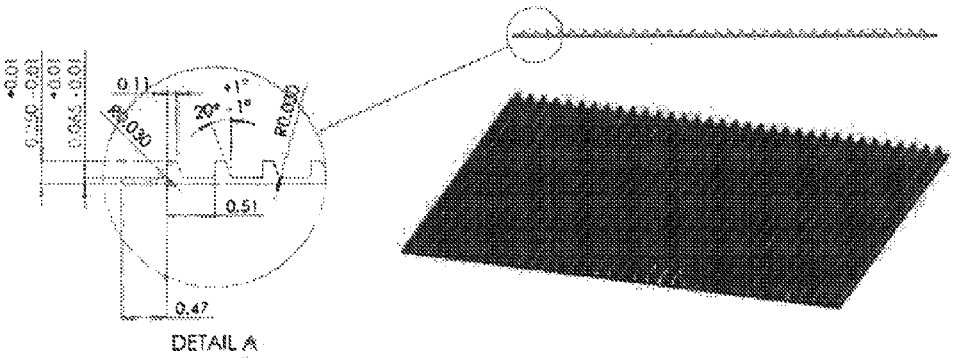

Figure 7 Curved and conformal serrated plate designs
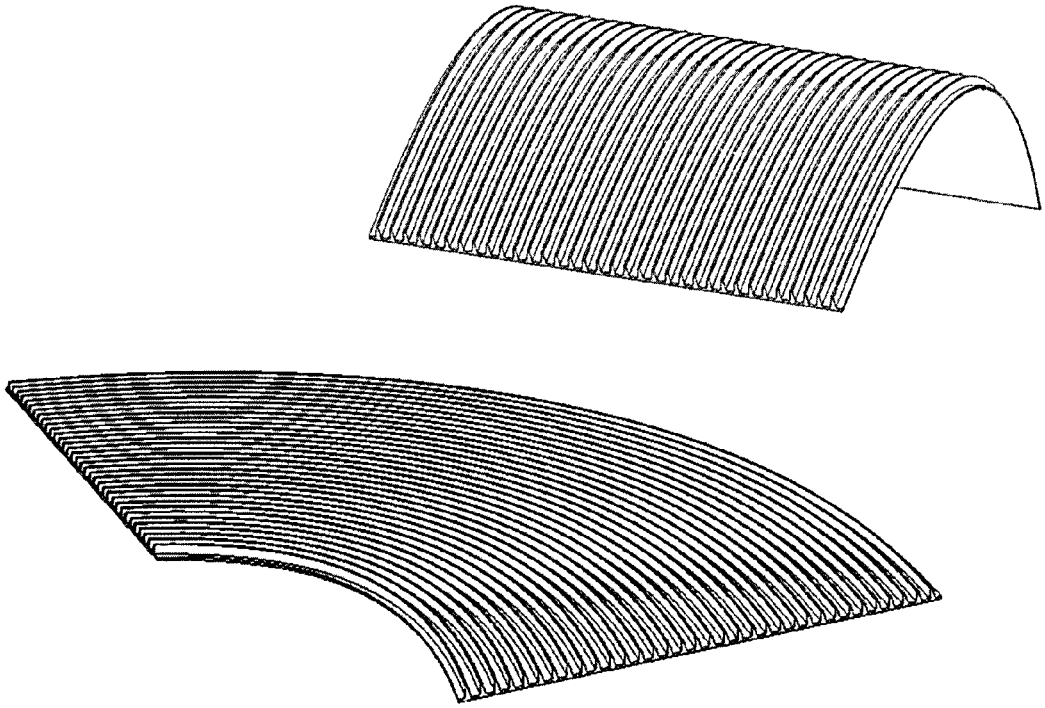

Figure 8 Illustration of hardened steel serrated plate interaction with 0.50 AP M2
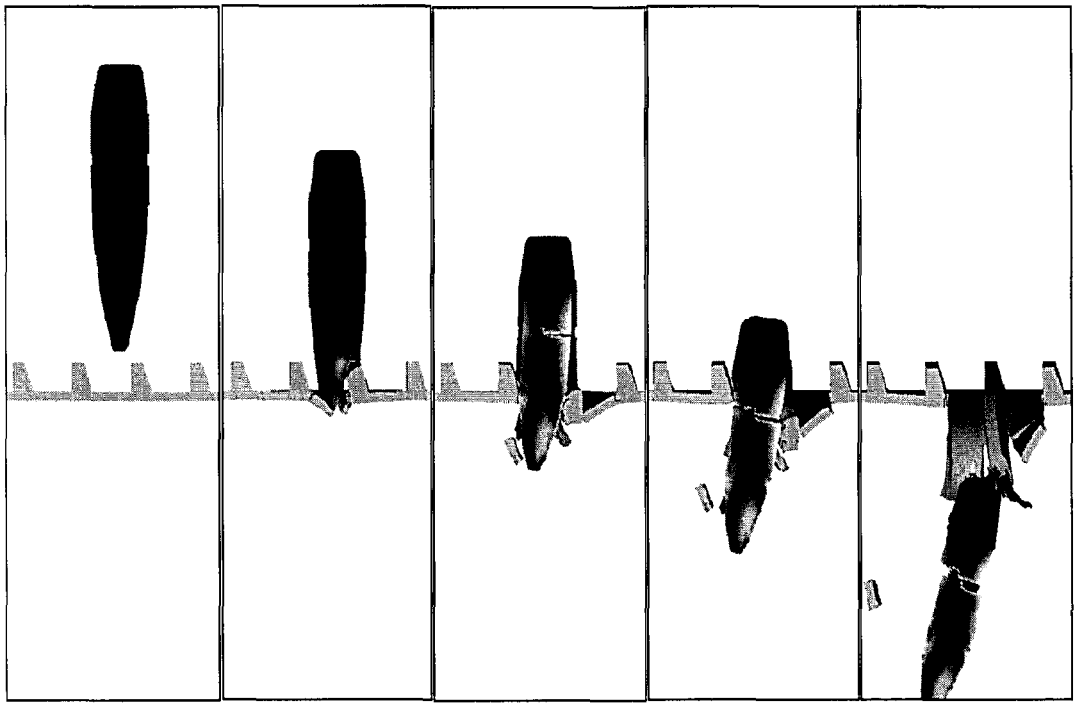

Figure 9 Illustration of an armor system design using multiple serrated plates, and projectile receptor.
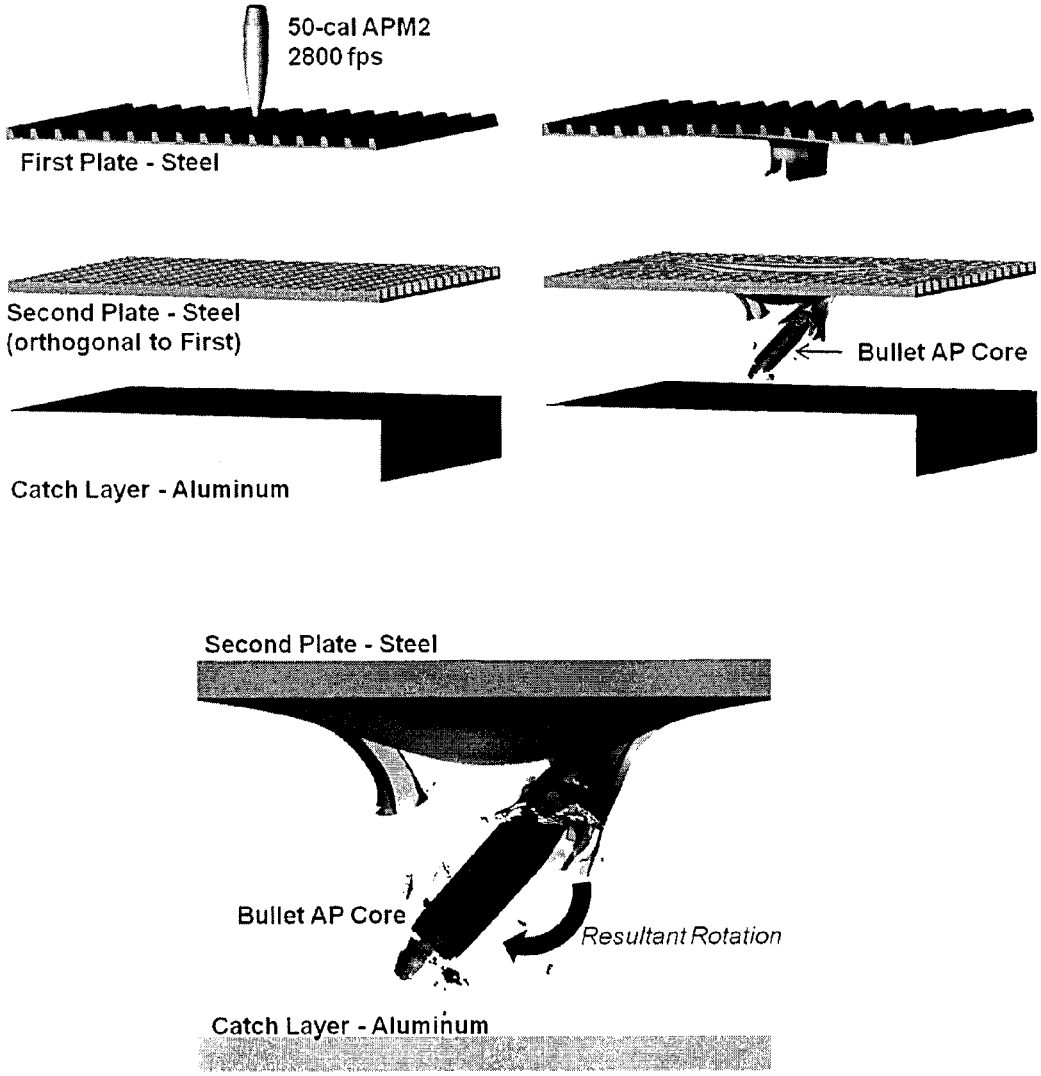

Figure 10 Louvered plate system
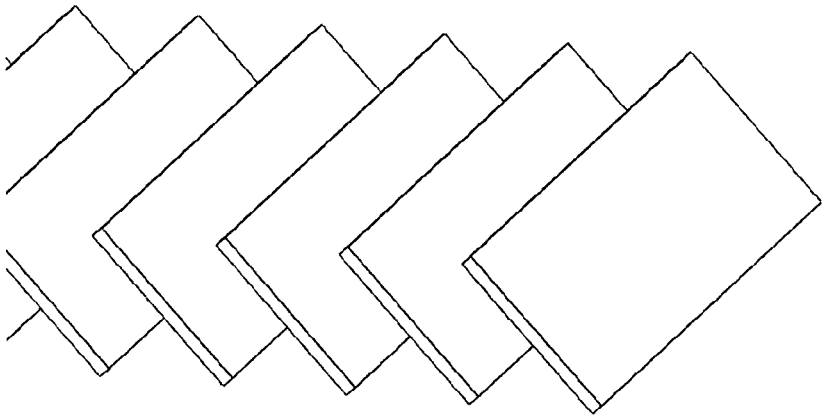
Figure 11 Cross-section of louvered plate system
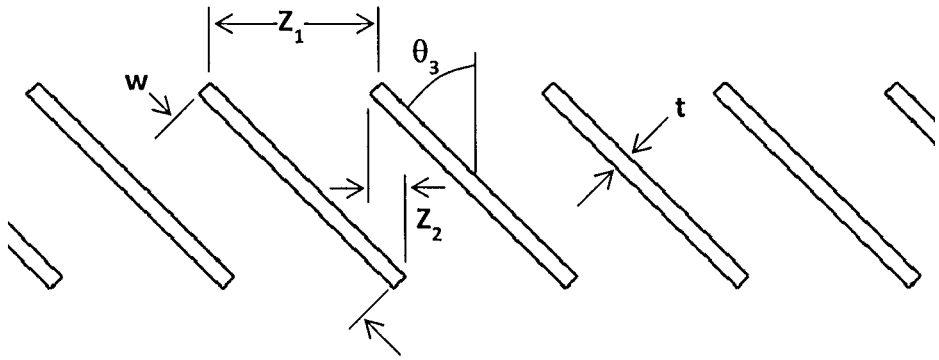

Figure 12A Specific louvered plate application with support structure
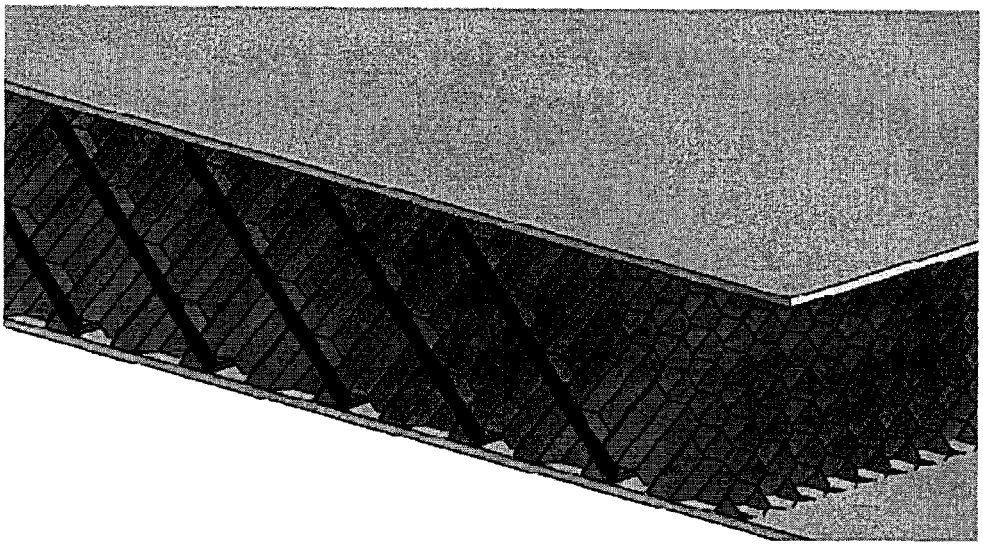
Figure 12B Specific louvered plate application with support structure
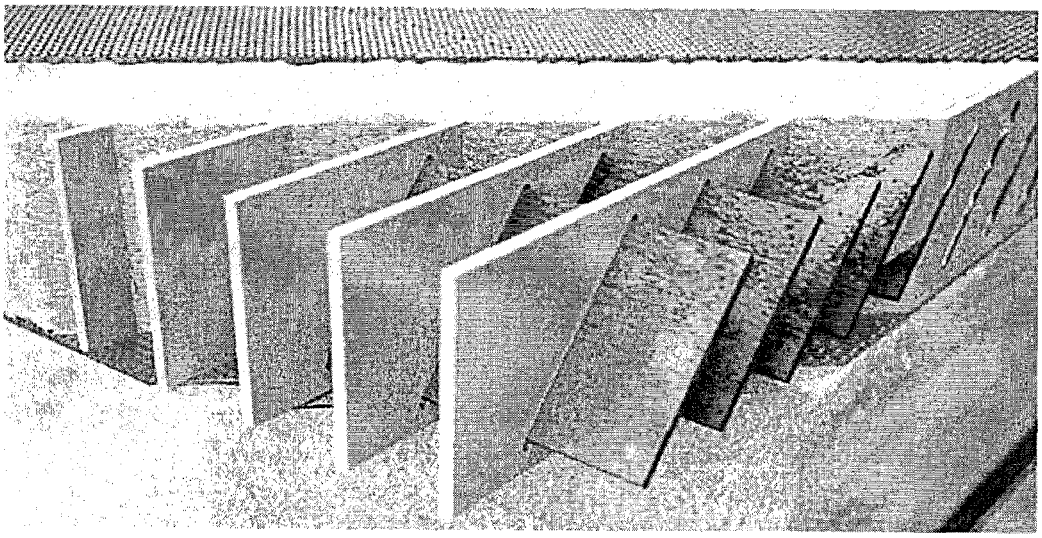

Figure 13 Illustration of an armor system design using a louvered plate system, and projectile receptor
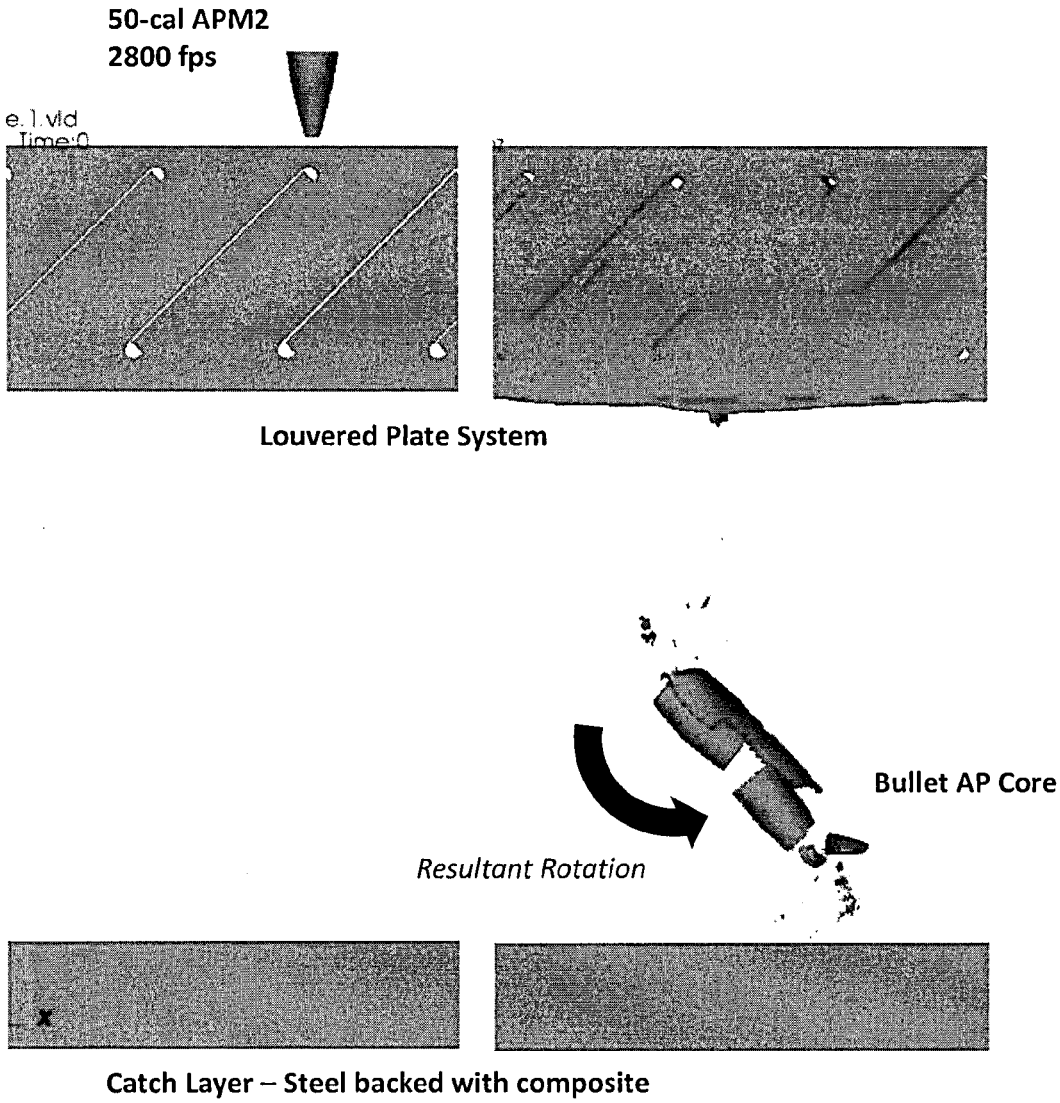

BALLISTIC ARMOR SYSTEM

CROSS REFERENCE TO RELATED APPLICATIONS

This application is related to and claims priority under 35 U.S.C. 119(e) to U.S. Application Ser. No. 61/393,665, filed Oct. 15, 2010, entitled "BALLISTIC ARMOR SYSTEM," the entire contents of which are incorporated herein by reference.

BACKGROUND OF THE INVENTION

1. Field of the Invention

The present invention is related to light weight armor components having enhanced capability to deflect and damage ballistic projectiles and threats.

2. Description of the Related Art

In recent years armor designs have moved away from homogeneous metallic plates. Current designs often use a range of materials, including: metals (e.g. steel, aluminum, titanium), ceramics (e.g. alumina, boron carbide, silicon carbide), and various fibers and polymers (e.g. aramids, polyethylene, S-2 glass). U.S. Pat. Nos. 5,149,910 and 4,739,690 exhibit this approach.

U.S. Pat. No. 4,739,690, entitled "Ballistic Armor with Spall Shield Containing an Outer layer of Plasticized Resin," describes the use of layers of different materials to progressively manage the absorption of energy from a projectile. The contents of these and the other patents referenced in this application are incorporated by reference in their entirety.

U.S. Pat. No. 5,149,910, entitled "Polyphase Armor with Spoiler Plate," describes the use of a corrugated spoiler plate to initiate a "chain of events" as part of an overall armor solution that consists of a spoiler plate, alumina ceramic cells, and an aluminum backing. U.S. Pat. No. 5,736,474, entitled "Multi-Structural Ballistic Material," describes embedded structures intended to alter a bullets path and/or divert by crush the bullet structure. This patent specifies the use of ballistic resistant woven and nonwoven fibers that act as packaging and support for the divert structures, and serve to absorb energy directly. Accordingly, modern armor solutions employ a variety of materials to arrest ballistic threats.

SUMMARY OF THE INVENTION

In one embodiment of the invention, there is provided an armor having at least one serrated plate or louvered plate assembly. The serrated plate has a base, recessed lands, raised lands, and columnar projections extending from the recessed lands to the raised lands to form serrations on the serrated plate. The louvered plate assembly includes a series of flat plates, oriented at an oblique angle with respect to the ballistic threat.

In one embodiment of the invention, there is provided a method for projectile neutralization. The method includes impacting the projectile on at least one serrated plate having a base, recessed lands, raised lands, and columnar projections extending from the recessed lands to the raised lands, or impacting the louvered plate assembly that includes a series of flat plates oriented at an oblique angle with respect to the ballistic threat. The method includes reducing a kinetic energy of the projectile and re-orienting the projectile upon rupture through the at least one serrated plate or louvered plate assembly.

In one embodiment of the invention, there is provided a system for projectile neutralization. The system has an armor plate (serrated or louvered) configured to reduce a kinetic energy of the projectile and re-orient the projectile upon rupture through the armor plate. The system has a projectile-receptor configured to capture the projectile after rupture through the armor plate.

It is to be understood that both the foregoing general description of the invention and the following detailed description are exemplary, but are not restrictive of the invention.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein:

FIG. 1A is a depiction of the composition and construction of a .50 caliber AP M2 bullet;

FIG. 1B is a depiction of a projectile impact orientation on an armor panel;

FIG. 2 is a photographic depiction showing three of the projectiles from Table 1;

FIG. 3 is a depiction of a serrated armor plate of the invention showing a size, a depth of serration, a width of serration of the plate;

FIG. 4 is a detailed cross section of a serrated armor plate of the invention;

FIG. 5 is a depiction of a double-sided serrated armor plate of the invention showing a size, a depth of serration, a width of serration of the plate;

FIG. 6 is a depiction of a specific single face serrated design of the invention;

FIG. 7 is a depiction of 1) a concave serrated design of the invention and 2) a contoured serrate design of the invention;

FIG. 8 is a depiction of computer simulation results of a hardened steel serrated plate interaction with a 0.50 AP M2 projectile;

FIG. 9 is a depiction of an armor system of the invention having multiple serrated plates and a projectile receptor.

FIG. 10 is a depiction of a louvered plate assembly invention showing a size, an angle, and an arrangement of the assembly;

FIG. 11 is a detailed cross section of a louvered plate assembly;

FIGS. 12A and 12B are depictions of a specific design of the invention; and FIG. 13 is a depiction of computer simulation results of a louvered plate assembly interaction with a 0.50 AP M2 projectile.

DETAILED DESCRIPTION OF THE INVENTION

The inventors have performed testing and simulation studies examining the effect of projectile impact on armor surfaces and the projectile penetration into the armor.

Armor materials are arranged in various configurations to form systems that are intended to maximize projectile defeat for minimum areal density and volume. Arrangements are also dictated by the operational limitations of component materials. For example, ballistic-grade ceramics components are brittle and may experience catastrophic failure if subjected to what would be typical, safe, operational loads for the same components made from polymers or metals, e.g. ceramic body armor plates dropped to the ground by a wearer after being removed. U.S. Pat. No. 7,604,876 is an example of a solution intended to mitigate the fragility of ceramic armor components, and is also described in U.S. Pat. No. 6,408,734. Another example is the degradation of ballistic resistance of aramid fiber in damp environments due to the hygroscopic nature of the fiber.

There is a broad range of ballistic threats, and armor systems are most often designed to address a specific class of threat; more aggressive threats require heavier armor. Projectile threats have two primary forms: 1) bullets fired from small arms and machine guns, 2) fragments created by the explosion of metal cased ordnance. The nature and effectiveness of ballistic threats is generally a function of four projectile parameters: composition, mass, velocity, shape. Table 1 provides parameters for threats typically under consideration when evaluating armors intended for protection of military/police/infrastructure assets and personnel. FIG. 2 is a photograph showing three of the projectiles from Table 1.

There are numerous US Government standards that classify threats and armor protection levels, such as National Institute of Justice (NIJ) Standard 0108.01. The US Department of Defense (DoD) issues various specifications for ballistic protection of individual weapons, transport, and materiel systems, and individual body armor systems. These DOD standards are often unified with North Atlantic Treaty Organization Standards as Standardization Agreements (STANAG), e.g. STANAG 4241 Ed. 2 Bullet Impact, Munitions Test Procedures.

Threats of harder composition, higher mass, and higher velocity require heavier and/or more complex forms of armor. Long, slender bullet shaped projectile that impact tip first are more effective at defeating armor than shorter projectiles of the same mass, composition, and impact velocity. The ratio of projectile mass to the area of contact during impact is termed "sectional density." All other parameters held equal, lower sectional density creates lower the pressures in an armor material, and thus less penetration results.

Bullet "ball" projectiles are composed of a copper alloy jacket, and lead filler that typically makes up more than 90% of the mass of the bullet. The relatively soft composition ball rounds tend to deform and expand when impacting armor. This expansion increase sectional density and may lead projectile breakup. Both changes result in less penetration potential for a given armor system.

Bullet "Armor Piercing" (AP) projectiles are composed of hardened metal cores such as hardened steel or tungsten carbide. FIG. 1A illustrates the composition and construction of a .50 caliber AP M2 bullet. The steel core for this bullet has a hardness of 63 on the Rockwell C scale. The resistance of the AP core deformation and/erosion hard core AP bullets is very effective in defeating various armor designs.

The inventors have performed testing and simulation studies examining the effect of projectile impact orientation relative to armor surface normal and the influence with regard to penetration into armor. There is particular influence for bullets as compared to fragment threats. Specific variables include the angle of projectile trajectory relative to the armor surface normal defined as "impact obliquity", and the angle of the projectile long axis relative to the trajectory is defined as projectile "yaw", see FIG. 1B.

Deviation from zero obliquity and zero yaw influences penetration in four primary ways: 1) sectional density affect, 2) tendency to deflect/redirect momentum, 3) increase in penetration path length, 4) tendency to induce yaw in the projectile. This fourth effect, induced yaw, can lead to bullet instability characterized by ever increasing yaw. Projectile sectional density is reduced as a yawing projectile penetrates armor, which leads to lower interface pressures and less penetration potential.

Evaluation of armor against ordnance fragment threats is typically accomplished using Fragment Simulating Projectiles (FSP) as surrogate for actual fragmenting metal bomb casings. FSPs enable consistent, controlled launch velocities and stable flight to achieve accurate hit points during armor testing. FSP relevant modern military armor systems are defined under DOD specification MIL-DTL-46593B and NATO STANAG 4496. Some of the defined fragment sizes and weights are shown in Table 1. Fragment threats, and by extension FSPs, differ from bullets in three key ways: 1) lower sectional density, 2) steel composition, 3) higher test velocities.

Compared to bullets, the lower sectional density of fragments is more than compensated for by higher impact energy. Due to relatively ductile steel composition, fragment deformation during armor penetration also differs from that of bullets. Fragments show some of the expansion, i.e. "mushrooming," that lead core bullets exhibit.

TABLE 1

Ballistic threats for armor evaluation

| Threat | Standard | Diameter (mm) | Overall Length (mm) | Mass (g) | Composition | Velocity (m/s) | Energy (kJ) |
|---|---|---|---|---|---|---|---|
| .22 cal FSP | DTL-46593B | 5.5 | 2.54 | 1.1 | Steel, RHC[2] 30 | 2530[4] | 3.5 |
| .30 cal FSP | DTL-46593B | 7.52 | 3.45 | 2.9 | Steel, RHC[2] 30 | 2530[4] | 9.1 |
| .50 cal FSP | DTL-46593B | 12.6 | 5.7 | 13.4 | Steel, RHC[2] 30 | 2530[4] | 43 |
| 20 mm FSP | DTL-46593B | 20 | 22.9 | 53.8 | Steel, RHC[2] 30 | 2530[4] | 172.3 |
| STANAG 14.3 mm FSP | 4496 | 14.3 | 15.56 | 18.6 | Steel, RHC[2] 30 | 2530[4] | 59.6 |
| 9 mm, Ball Bullet | NIJ 0108.01, Level II | 9 | 15.5 | 8 | Lead, FMJ[3] | 427 | 0.7 |
| 7.62 mm M59 Ball Bullet | NIJ 0108.01, Level III | 7.62 | 32.5 | 9.7 | Lead, FMJ[3] | 839 | 3.4 |
| .30-06 AP[1] | NIJ | 7.62 | 35.6 | 10.8 | Steel, RHC | 869 | 4.1 |

TABLE 1-continued

| Ballistic threats for armor evaluation | | | | | | | |
|---|---|---|---|---|---|---|---|
| Threat | Standard | Diameter (mm) | Overall Length (mm) | Mass (g) | Composition | Velocity (m/s) | Energy (kJ) |
| M2 Bullet | 0108.01, Level IV | | | | 63, FMJ[3] | | |
| .50 cal AP M2 Bullet | STANAG 4241 | 12.9 | 58.7 | 45.3 | Steel, RHC 63, FMJ[3] | 854 | 16.5 |

[1]AP, Armor Piercing, characterized by a hardened steel core
[2]RHC, Hardness on Rockwell C scale
[3]FMJ, Full Metal Jacket, Jacket is typically a soft copper alloy
[4]Gurney velocity limit for fragments formed by military high explosive From these studies and the simulations described below, armor components have been developed which exhibit an enhanced capability to deflect and damage ballistic projectiles and threats as compared to conventional armor plates. Moreover, the armor components of the inventions (as compared to conventional armor) are lighter in weight. Indeed, one key design goal for armor is to minimize the mass of the armor per unit area of coverage, or areal density, e.g. $1b/ft^2$, and thus the burden on vehicles, aircraft, etc. The basic operational principle of these systems is to provide resistance that absorbs energy from projectiles and brings its momentum to zero within the armor assembly.

Moreover, the armor components of the invention can provide protections against a broad range of threat projectiles, and effectiveness against "armor piercing" projectiles are highly desired. According to the present invention, the armor components can exhibit improved tolerance to multiple impacts and overall robustness through the use of ductile materials. The armor of the present invention has applications in vehicle and aircraft armor, body armor and shields, shielding of buildings and materiel, containment of shrapnel, and other applications. The armor of the present invention is useful in a stand-alone capacity, or as an appliqué to augment existing armor systems.

In one embodiment of the invention, there is provided a serrated armor plate which is configured in size, depth of serration, width of serration, and material of the plate to deflect and damage ballistic projectiles upon entry. As shown in FIGS. 3 and 4, the plate contains recessed lands and raised lands with columnar tapered projections extending from the recessed lands to form the raised lands.

In another embodiment of the invention, there is provided a louvered plate system which is configured in overall size, width of each louvered plate, angle of each louvered plate, and material of the plate to re-orient and damage ballistic projectiles upon entry. As shown in FIGS. 10 and 11, the plates are flat, at a non-zero angle, and arranged in a series such that there is no open passage for a projectile having a flight path near 90 degrees, relative to the overall plate array.

A serrated surface armor component or a louvered plate armor component and configurations for employing either component in a protective armor system have been developed. The serrated surface or louvered plate system both act on projectiles in two advantageous ways:

1) Induce yaw and instability in high sectional density projectiles, e.g. armor piercing bullets; and
2) Create stress concentrations in impacting projectiles that result in projectile break up.

Advantages of each include:

1) Enhanced performance under multiple impacts (multi-hit);
2) Eliminating this use of brittle ceramics to produce pressures high enough to cause projectile fracture,
   a. Reduced cost, and
   b. Increase multi-hit performance;
3) Effective against a broad range of threats, including lead and steel core bullets, AP bullets, and fragment; and
4) Effective as a retrofit to enhance existing armor systems.

The serrated component in one embodiment can be considered as a set of serrate "teeth" extending outward from a supporting surface. Serrate teeth may extend from one of both sides of a supporting surface. FIGS. 4 and 5 illustrate the design. The geometric serrated design in one embodiment of the invention is based on the following parameters, illustrated in FIG. 4:

Y1, Overall component thickness
Y2, Tooth height
X1, Tooth pitch
X2, Gap width
Θ1 and Θ2, Tooth slopes These parameters define the width and pitch of the lands, the taper angle of the columnar projections, and the thickness of the entire serrated plate and the base of the serrated plate. These parameters may be varied to maximized component effectiveness while minimizing areal density. Design variations may be driven by the nature of the ballistic threat, or threat set. The above parameters can be adapted to enable the serrated plates to function in a dual purpose role as both an armor protection component and also in carrying structural loads.

Tooth pitch, X1, and Tooth gap, X2, vary as a function of threat projectile diameter(s). Larger diameter threats and AP threats are given more weighting in determining these parameters. For instance, X1 and X2 are 13 mm and 10 mm, respectively, in a design solution where the most aggressive threats are .50 cal AP and 14.3 mm fragment.

Tooth taper angles Θ1 and Θ2 may individually range from 0° to 45°. Dissimilarity in Θ1 and Θ2 produces advantageous asymmetric forces on the projectile in the instances where it impact near one-half X2. Therefore, unequal Θ1 and Θ2 is the most desirable design. Development works shows that 0° Θ1 and Θ2 produces high induced yaw and projectile damage, but has a lower efficiency in terms of areal density.

As shown in FIG. 5, there is provided in this invention a dual serrated armor plate configuration having a serration configuration provided on both sides of the armor plate. This configuration provides additional deflection capability and/or provides for additional resistance of the plate to the projectile.

FIG. 6 illustrates a specific single face serrated design. In this particular example, the serrated armor plate of the invention has been realized in a design made of a hardened steel alloy where X1 was 13 mm, X2 was 10 mm, Y1 was 6.4 mm, Y2 was 4.7 mm, Θ1 was 20⌒, and Θ2 was 0⌒. During the inventors' development of the armor of the invention, plates of this design were machined from 4130 alloy steel. Heat treat hardening to approximately 47 on a Rockwell C scale was done after machining.

In another particular example, the serrated armor plate of the invention has been realized in a design made of ANSI 4340 grade steel hardened to HRC 52, where X1 was 3 mm, X2 was 4.4 mm, Y1 was 7.6 mm, Y2 was 5.5 mm, Θ1 was 20⌒, and Θ2 was 0⌒.

In another particular example, the serrated armor plate of the invention has been realized in a design made of ANSI 4340 grade steel hardened to HRC 52, where X1 was 14.1 mm, X2 was 11.3 mm, Y1 was 9.5 mm, Y2 was 7.4 mm, Θ1 was 20⌒, and Θ2 was 0⌒

In the case of the dual faced design, characterized by serrates on both sides of the base surface, the shape and orientation of the teeth may be the same or different on each side. The relative angle between the teeth ridges may range from 0° to 90°. Teeth on each side may be aligned or offset.

The louvered plate component can be considered as a series of flat angled plates in the armor system. FIGS. 10 and 11 illustrate the design. The geometric louvered plate design in one embodiment of the invention is based on the following parameters, illustrated in FIG. 11:

w, Overall plate width t. Overall plate thickness

Z1, plate pitch

Z2, plate overlap width

Θ3, plate angle

These parameters define the overall plate dimensions and the positioning of the plates. These parameters may be varied to maximize component effectiveness while minimizing areal density. Design variations may be driven by the nature of the ballistic threat, or threat set. The above parameters can be adapted to permit louvered plates to function in a dual purpose role as both an armor protection component and also in carrying structural loads.

Plate width and thickness, w and t, vary according to the severity of the threat, i.e. sufficient width and thickness is necessary to turn/break up the given projectile. Plate pitch and overlap width, Z1 and Z2, must be sized to ensure no gaps exist between plates, as viewed at 90 degrees to the overall array, and plates can withstand multiple threat impacts without tearing completely apart. Plate angle, Θ3, can be between 0 and 90 degrees, where most effectiveness is expected between 30 and 60 degrees.

In one embodiment, the louvered plates are anchored in place using lightweight, rigid support structure designed to localize threat damage and increase effectiveness against multiple projectiles impacting in series and in close proximity. FIGS. 12A and 12B show two specific support structure configurations. The specific application shown in FIG. 12A employs support structure including aluminum honeycomb core and fiberglass facesheets to encapsulate the plates. In this particular design, the plates are hardened AISI 4340 steel where w=2", t=0.118" and Θ3=45 degrees. The specific application shown in FIG. 12B employs support structure including stamped aluminum panels, foam core, and fiberglass facesheets to encapsulate the plates. In this particular design, the plates are AISI 4340 steel, hardened to 48 on a Rockwell C scale, where w=2", t=0.118" and Θ3=48 degrees.

In one embodiment of the invention, the serrated or louvered armor components of the invention may be comprised of materials appropriate for the identified ballistic threats, operating environment, and structural requirements. Appropriate metals may include steel, aluminum, titanium, beryllium, copper, and their alloys. Specific alloys include hardened AISI 4340 and 4130 steel, Ti-6AL-4V titanium (ASTM Grade 5), 7075-T6 aluminum, 7039-T64, 2195-BT aluminum, 2139-T8 aluminum. Serrated or louvered armor components made of these metals are relatively ductile compared to typical ceramic strike faces. Damage propagation is much lower in these metal solutions, relative to ceramics, thus armor performance is improved in multiple hit scenarios, e.g. .50 cal AP M2 "triple shot" evaluation described in STANAG 4241.

Composites comprised of fibers in a supporting matrix may also be used for serrated or louvered plate construction. Candidate fibers include glass, aramid, carbon, basalt, boron, polypropylene, and ultra high molecular weight polyethylene. Ceramics such as alumina, silicon carbide, boron carbide, titanium nitride, and titanium diboride might also be used to for all or part of the serrated or louvered armor component.

Appropriate processes for serrated plate fabrication are based on the material and geometry. Metal serrated plates might be machined or forged, with intermediate or post-process heat treatment as required. Large scale production of steel serrated plates can employ hot-rolling processes. For aluminum, components can be formed using extrusion. Composite serrated plate components might be formed using molds or pultrusion. Metal and/or ceramic components might be embedded in composite bulk geometries.

Serrate component plates may be curved, as illustrated in FIG. 7, to provide conformation to protected assets. Serrate teeth may be straight or curved as illustrate in FIG. 7. In one embodiment of the invention, the serrated plate of the armor assembly is formed into curved sections, as shown in FIG. 7. The curved section provides additional strength to the serrated plate. The curved section provides additional projectile-resistance to the serrated plate. In one particular example, the serrated armor plate of the invention has been realized in a design made of 4340 steel, where X1 was 13 mm, X2 was 10 mm, Y1 was 6.4 mm, Y2 was 4.7 mm, Θ1 was 20⌒, and Θ2 was 0⌒ 〉 and R (the radius of curvature) was 0.5 m.

In one embodiment of the invention, the serrated plate of the armor assembly is formed into conformal sections, as shown in FIG. 7. Here, in this embodiment, the serrated plate can be made to conform around objects such as gun portals or sight windows to permit the armor not to interfere with the offensive utility of the vehicle being protected.

Because the individual plates in the louvered plate system are typically flat, the fabrication process focuses on plate arrangement and integration with support structure. Curved louvered plate systems can also be used in curved applications similar to those described for the serrate component as illustrated in FIG. 7.

In one embodiment of the invention, the serrated or louvered plate components can be used in a system designed for a particular projectile (or range of projectiles) to maximize protection from the projectile threat. In one embodiment of the invention, the serrated or louvered plate components can be used to augment existing armor systems. In the case of existing systems, the serrated or louvered plates would be employed as an appliqué. One or more serrated plates our louvered plate systems can be applied. In this appliqué capacity, the serrated plate(s) or louvered plate system acts to initiate damage to a projectile, "pre-conditioning" the projectile, thus making the existing armor more effective and elevating the protection level of the overall system.

The attributes of the invention are more fully understood in light of the following non-limiting discussion of the function of the serrated plate of the armor assembly. FIG. 8 depicts results from a computer simulation of a hardened steel serrated plate interaction with a 0.50 AP M2 projectile entering at 2800 fps. In this simulation, the serrate armor plate was made of ANSI 4340 grade steel hardened to HRC 52, where X1 was 13.4 mm, X2 was 10.6 mm, Y1 was 7.6 mm, Y2 was 5.5 mm, Θ1 was 20⌒, and Θ2 was 0⌒.

As seen from FIG. 8, the projectile upon entry on the recess land pierces the base of the serrated plate. With the pitch between lands being less than the width of the projectile, the sides of the projectile collide with the tapered columns and the raised lands. The interaction of the projectile with the tapered columns and the raised lands rotates the projectile such that more and more of the projectile must break through the serrated plate. Further, as the projectile progresses through the serrated plate under this rotation considerable drag resistance builds as the projectile now presents a larger areal projection to interact with the ruptured serrated plate. The net effect is to slow and turn the axis of the projectile such that its encounter with any material underneath the serrated plate is with reduced velocity and without the point of the projectile aligned on axis for penetration of the material underneath.

In one embodiment of the invention, one or more serrated plates can be used in an armor system. FIG. 9 illustrates this type of system. This system has been built and has been tested. This design uses the 4130 steel plates spaced approximately 2.5" apart, and 2.5" separation from a backing. The backing is a 1.25" thick 7075-T6 aluminum. The tested assembly has a glass fiber/epoxy overwrap to provide environmental protection. The overall dimensions were 18" on the sides and a thickness of less than 7". In this arrangement, the serrated plates acted to induce yaw and to fragment a 0.50 AP M2 threat. While a significant part of the threat velocity is retained, the fractured and rotated pieces have a lower sectional density and disposed momentum. These affects allow the backing plate to arrest the threat, while incurring minimal damage.

Testing and computer simulations indicate that a system composed of two serrate steel plates and an aluminum back, and a system areal density of less than 38 pounds per square foot, can arrest a .50 caliber AP M2 projectile impacting with a velocity of approximately 2800 feet per second, and obliquity and yaw of less than 2 degrees.

FIG. 9 depicts more specifically results from a computer simulation of an armor system design using first and second single-side serrated plates and an underlying aluminum plate. This armor system design as noted above has been built and has been tested. The computer simulation shows the calculated projectile response. In this simulation, a 0.50 AP M2 projectile enters a first serration plate at 2800 fps. In this simulation, the first serrate armor plate was made of HHA steel, where X1 was 14.1 mm, X2 was 11.3 mm, Y1 was 9.5 mm, Y2 was 7.4 mm, Θ1 was 20⌒, and Θ2 was 0⌒. In this simulation, the second serrate armor plate was made of HHA steel, where X1 was 14.1 mm, X2 was 11.3 mm, Y1 was 9.5 mm, Y2 was 7.4 mm, Θ1 was 20⌒, and Θ2 was 0⌒. The second serrated plate is disposed such that its serrations are rotated with respect to the serrations of the first plate. In this simulation, the first and second plates have their respective serrations disposed rotated orthogonally. In this simulation, the projectile impact velocity is 854 m/s, 0° yaw and obliquity for a 0.50 AP M2 projectile.

As seen from FIG. 9, the projectile upon penetration of the first serrated plate is slowed and rotated. The projectile upon penetration of the second serrated plate is further slowed and rotated. As shown in FIG. 9, the projectile then impacts a ductile material such as aluminum where its kinetic energy is dissipated, and the projectile is stopped.

In one embodiment of the invention, as shown in FIG. 9, the armor assembly includes a projectile receptor disposed underneath one or more serrated plates to stop the projectile. The projector receptor is made of a ductile component which provides resistance that absorbs energy from projectiles and brings its momentum to zero within the armor assembly, yet has a limited damage radius compared to ceramics. Specific alloys include hardened AISI 4340 and 4130 steel, Ti-6AL-4V titanium (ASTM Grade 5), 7075-T6 aluminum, 7039-T64, 2195-BT aluminum, 2139-T8 aluminum.

Similarly, FIG. 13 depicts results from a computer simulation of a hardened steel louvered plate system interaction with a 0.50 AP M2 projectile entering at 2800 fps. In this simulation, the louvered armor plate was made of ANSI 4340 grade steel hardened to HRC 52, where Z1 was 1.4", Z2 was 0.25", w was 2", t was 0.118", and Θ3 was 48⌒. The steel plates are held in place by a series of aluminum supports similar to that depicted in FIG. 12B. The backing plate, or projectile receptor, is located approximately 4" from the bottom of the louvered plate system, including high hard armor (HHA) per Mil-A-46100, backed with composite laminate.

Moreover, in one embodiment of the invention, the serrated or louvered plates are also made of a ductile component. The advantages of ductility are significant in both the forward serrate or louvered components and the rearward catch panel (as noted above). Remarkably, a ductile serrated or louvered plate is as effective as ceramics in "breaking" hardened projectiles, but the ductile serrate or louvered plate is more robust than a ceramic. Ceramics tend to fracture catastrophically, with a failure radius many times the diameter of the impacting projectile. Effectiveness within this radius is severely reduced. On the other hand, a ductile serrated or louvered plate would have a much smaller damage radius, and this be less vulnerable to subsequent impacts.

Numerous modifications and variations of the invention are possible in light of the above teachings. It is therefore to be understood that within the scope of the appended claims, the invention may be practiced otherwise than as specifically described herein.

The invention claimed is:

1. A system for projectile neutralization, comprising:

an armor plate structure having at least two non-brittle projection members and a non-brittle retaining member joining the at least two non-brittle projection members across a central region of the armor late structure the armor late structure reduces a kinetic energy of the projectile and re-orients the projectile upon rupture through the armor plate structure;

a projectile-receptor comprising a separate unit from the armor plate structure and configured to capture the projectile after rupture through the armor plate structure, wherein one or more of the non-brittle projection members presents one or more surfaces for interception of the projectile in front of the projectile receptor, and the non-brittle projection members extend across a substantial thickness of the armor plate structure.

2. The system of claim 1, wherein the armor plate structure has an areal weight density less than 38 pounds per square foot.

3. The system of claim 1, wherein the non-brittle projection member comprises a columnar projection extending from the retaining member on a side of the retaining member intercepting the projectile.

4. The system of claim 1, wherein the armor plate structure comprises a louvered plate structure or a serrated plate structure.

5. A system for projectile neutralization comprising: an armor plate structure comprising a non-brittle serrated plate having a base, recessed lands, raised lands, and columnar projections extending from the recessed lands to the raised lands; and a projectile-receptor comprising a separate unit from the armor plate structure and configured to capture the projectile after rupture through the armor plate structure, wherein the columnar projections extend across a substantial thickness of the armor plate structure.

6. The system of claim 5, wherein the armor plate structure comprises a first serrated plate and a second serrated plate, and serrations of the first serrated plate are aligned with second serrations of the second serrated plate.

7. The system of claim 5, wherein the armor plate structure corn rises a first serrated plate and a second serrated plate, and first serrations of the first serrated plate are orthogonal to second serrations of the second serrated plate.

8. The system of claim 5, wherein the armor plate structure comprises a double serrated plate, and first serrations on one side of the serrated plate are orthogonal to second serrations on an opposite side of the serrated plate.

9. A system for projectile neutralization comprising:

a louvered plate assembly:

a projectile-receptor comprising a separate unit from the louvered plate assembly and configured to capture the projectile after rupture through the louvered plate assembly; and said louvered plate assembly having 1) an array of angled plates comprising-non-brittle projection members, 2) a base, 3) a top, and 4) a support structure joining the non-brittle projection members across a central region of the armor plate structure and connecting the angled plates to the base and the top, said support structure contacting the angled plates at a plurality of interior positions removed from ends of respective ones of the angled plates.

10. The system of claim 9, wherein the said support structure comprises a honeycomb aluminum structure.

11. The system of claim 9, wherein said support structure comprises a plurality of aluminum plates.

12. The system of claim 9, wherein the angled plates are flat plates of constant cross-section.

13. The system of claim 9, wherein the base comprises a contoured section to contour around objects disposed beside the louvered plate assembly so as not to interfere with a function of the objects.

14. The system of claim 9, wherein the louvered plate assembly comprises at least one of steel, aluminum, titanium, beryllium, magnesium, copper, and alloys thereof.

15. The system of claim 9, wherein the louvered plate assembly comprises composites of fibers in a supporting matrix.

16. The system of claim 15, wherein the fibers comprise at least one of glass, aramid, carbon, basalt, boron, polypropylene, and polyethylene.

17. The system of claim 9, wherein the louvered plate assembly comprises a ceramic as part of the louvered plate assembly.

18. The system of claim 17, wherein the ceramic comprises at least one of alumina, silicon carbide, boron carbide, titanium nitride, and titanium diboride.

19. The system of claim 9, further comprising:

a projectile-receptor disposed underneath the louvered plate assembly and comprising at least one of steel, aluminum, magaesium, copper, titanium, tantalum, and alloys or mixtures thereof.

* * * * *